United States Patent [19]

Cummings

[11] 4,249,067

[45] Feb. 3, 1981

[54] TOY ELECTRIC CONVECTION OVEN

[76] Inventor: Charles A. Cummings, 3492 Cheviot Ave., Cincinnati, Ohio 45211

[21] Appl. No.: 2,894

[22] Filed: Jan. 12, 1979

[51] Int. Cl.[3] ..... H05B 3/00

[52] U.S. Cl. ..... 219/392; 219/400; 219/405

[58] Field of Search ..... 219/411, 405, 400; 46/1, 14, 226, 227, 228

[56] References Cited

U.S. PATENT DOCUMENTS

| | | | |
|---|---|---|---|
| 2,864,932 | 12/1958 | Forrer | 219/400 |
| 3,280,720 | 10/1966 | Kuhn | 219/411 |
| 3,368,063 | 2/1968 | Kuhn | 219/405 |
| 3,418,453 | 12/1968 | Sparks | 219/405 |
| 3,586,823 | 6/1971 | Schier | 219/405 |
| 3,769,495 | 10/1973 | Orfei | 46/226 |
| 4,003,142 | 1/1977 | Morrison et al. | 46/226 |

FOREIGN PATENT DOCUMENTS

| | | | |
|---|---|---|---|
| 1144482 | 10/1957 | France | 46/14 |
| 320792 | 10/1929 | United Kingdom | 46/14 |

*Primary Examiner*—C. L. Albritton
*Assistant Examiner*—Bernard Roskoski
*Attorney, Agent, or Firm*—Bacon & Thomas

[57] ABSTRACT

An improved toy oven for baking foods quickly that includes a baking chamber with inner and outer parallel walls constructed so as to attain a predetermined temperature rapidly, utilizing a single radiant energy source. The electric bulb heats the surrounding air and establishes a convection current which flows through the baking chamber to heat the food. The toy oven further includes an input shelf and an output shelf that function to provide cooling for the baking pans used with the oven, and their contents. A baking shelf in the baking chamber is arranged to be horizontal and together with the input and output shelves, and input and output doors of said chamber, form a continuous horizontal track upon which a baking pan is placed and pushed into said baking chamber for baking and then onto said output shelf for cooling, prior to being removed from the oven.

7 Claims, 8 Drawing Figures

TOY ELECTRIC CONVECTION OVEN

BACKGROUND OF THE INVENTION

This invention relates generally to toys, and particularly to an improved toy oven in which a child may safely bake many varieties of foods "just like mother's" but on a much reduced scale.

As they are growing up, many children accompany their mothers or fathers in the kitchen while they are preparing food for the family. Oftentimes, the child wants to participate with the parent or perhaps an older sibling in preparing such foods. However, due to the nature of the baking process, it is not usually safe for a small child to participate in such activities since there is a very great danger of the child coming in contact with a hot cooking or baking surface. Accordingly, there is a need for a toy to allow the child to express creativity and attain the satisfaction of having completed a desired baking or cooking task. the instant invention is aimed at satisfying just such a need.

It is known in the toy field to produce an oven for use by a child. U.S. Pat. No. 3,368,063 to Kuhn, also assigned to the assignee of this disclosure, discloses a toy oven for baking foods that includes a baking chamber and a cooling chamber disposed side by side, with openings in the walls of the baking and cooling chambers to provide a substantially horizontally aligned passageway through both chambers. The passageway contains opposed tracks to slidably support a baking pan so that pans can be moved successively through the baking chamber, the cooling chamber and out of the toy by inserting a pan into the baking chamber, thereby pushing the pan already in the baking chamber to the cooling chamber. The Kuhn oven utilizes two light bulbs located in the baking chamber, one each above and below the passageway, to create radiant heat for baking the food contained in the ovens. The instant device is an improvement thereover, and utilizes but one light bulb and an improved oven structure to significantly reduce the time required for baking.

Therefore, it is a primary object of the present invention to provide a miniature but fully operative oven that is as safe as possible for a child to operate.

It is a further object of the present invention to provide a toy oven which is more efficient in its use of electricity and at the same time greatly reduces the time required for baking.

It is a still further object of the present invention to provide a toy oven which is sufficiently insulated and vented so that there is no danger of a child being burned by touching any of the exposed parts of the oven, even though the oven may be small compared to conventional ovens.

Yet a further object of the present invention is to provide a toy oven in which provision is made for heating the food to be baked in a separate insulated compartment and in which provision is further made for cooling the pans in which the food is baked to a safe temperature within the confines of the toy oven prior to its being made readily accessible to the child using the oven.

Another object of the present invention is to provide a toy oven that can easily be operated by a child.

Still another object of the present invention is to provide a toy oven in which the average child can produce excellent baked products with very little instruction using either ready-mixed foods or individual recipes.

SUMMARY OF THE INVENTION

In fulfilling the above-mentioned objects, the instant invention comprises a baking chamber comprised of inner and outer parallel walls, input and output doors and shelf means for supporting baking pans prior to entering the baking chamber. The shelf means include portions immediately adjacent to and extending horizontally through the baking chamber from an input side to an output side thereof and include horizontal baking portions in the baking chamber, means for venting to the atmosphere the area of the baking chamber above the horizontal baking shelf, and a single radiant energy source disposed below the baking shelf for providing radiant heat to the oven, whereby the area of the baking oven defined by the inner walls is heated to a substantially constant temperature.

BRIEF DESCRIPTION OF THE DRAWINGS

The objects enumerated hereinabove, as well as additional features and advantages of the present invention, will become apparent to those skilled in the art as the description proceeds with reference to the accompanying drawings, wherein.

DESCRIPTION OF THE PREFERRED EMBODIMENT

Figure 1:
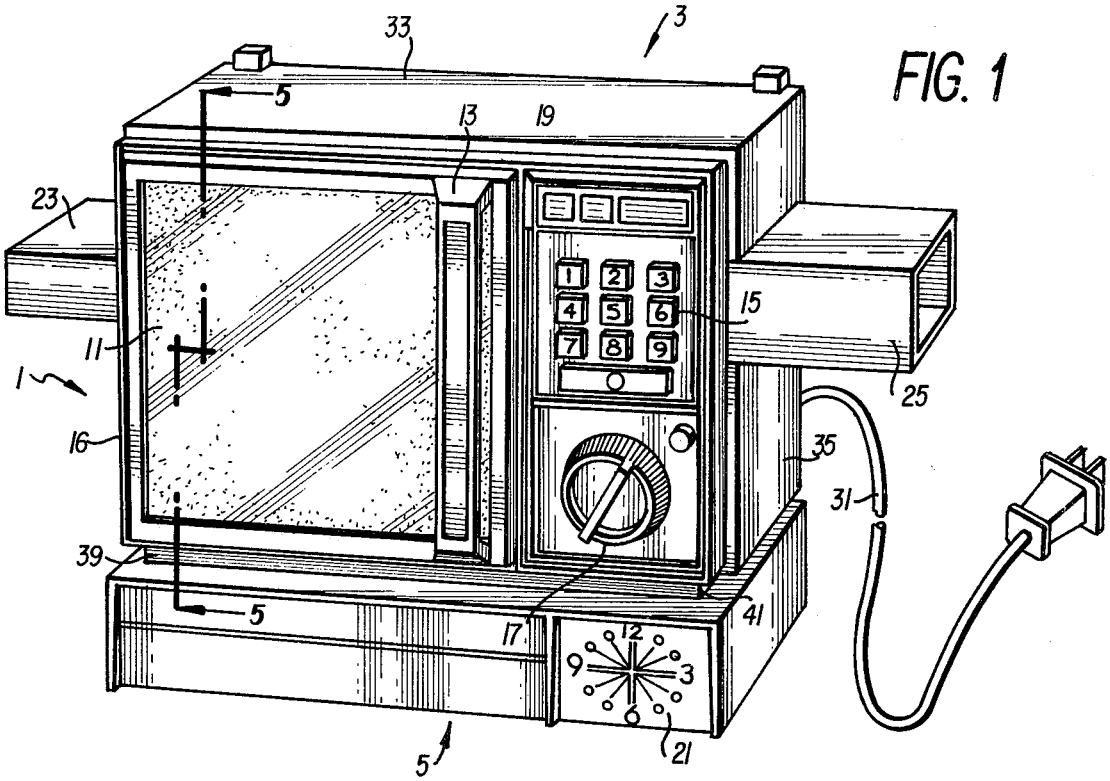
FIG. 1 is a perspective view of the toy baking oven of the present invention.
Figure 8:
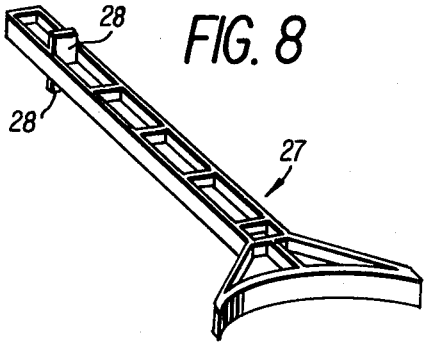
FIG. 8 is a perspective view of a pusher element used for moving the baking pans through the oven.
Figure 7:
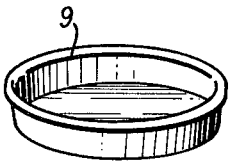
FIG. 7 is a perspective view of a baking pan for use with the oven.
Figure 3:
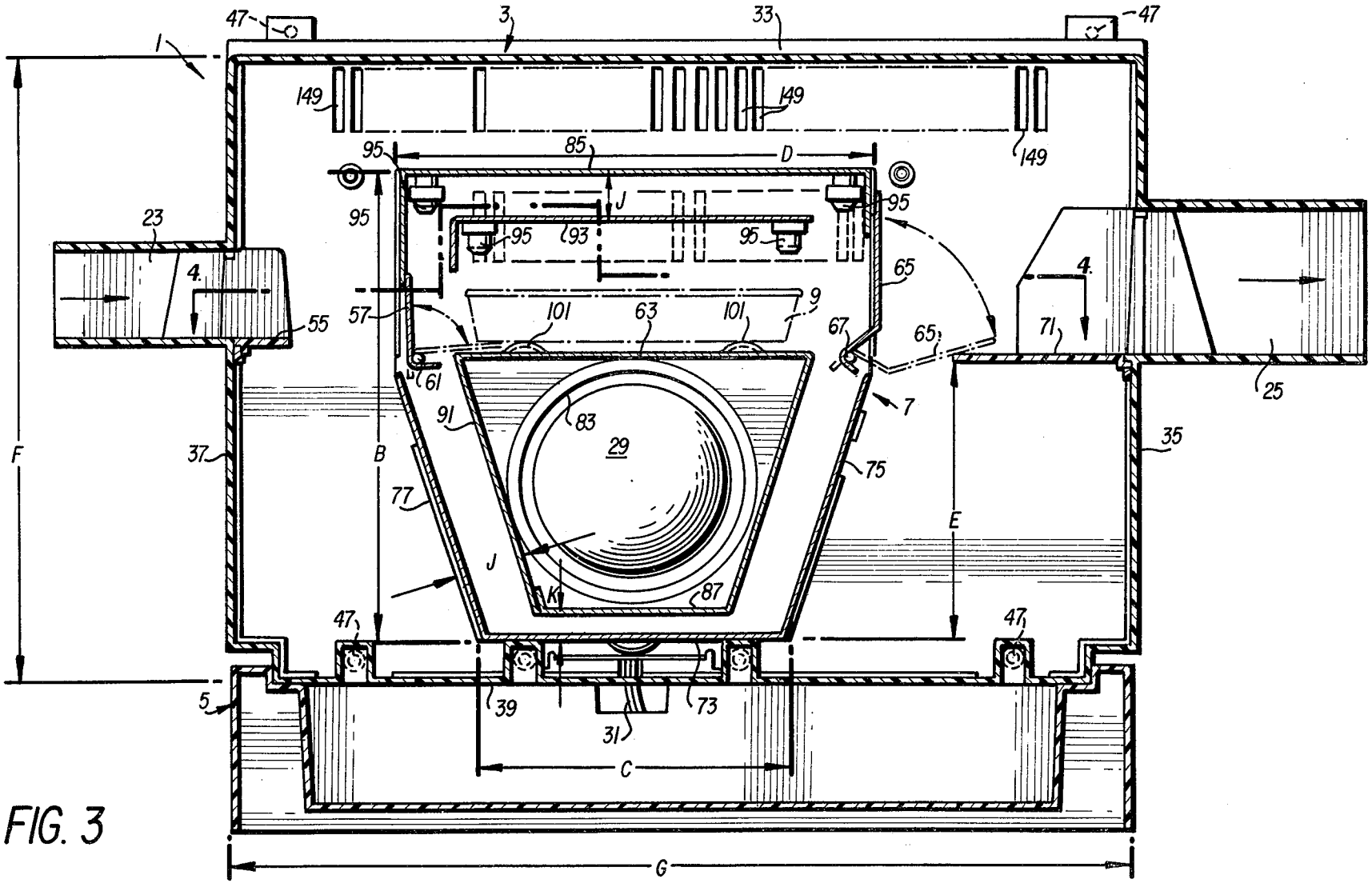
FIG. 3 is a vertical sectional view, taken on line 3—3 of FIG. 2.

Referring to FIG. 1, the outer shell 3 and the base 5 of the toy oven 1 are preferably molded of a heat and impact resistant plastic material to simulate a microwave oven. Generally, the shell 3 encloses a baking chamber 7. The baking is accomplished in this chamber 7 and means are provided for allowing the pan 9 in which the food is baked to cool prior to a child's taking the baked food out of the oven. This means is discussed further hereinbelow. To add to the realistic appearance, items such as a door 16 with a window 11 and a door handle 13 are attached or molded to the shell 3. Further, the oven is provided with molded push buttons 15 and a temperature control 17. All of these features, together with labels 19 and 21 which denote on, off and defrost switches and a clock respectively, are utilized to make the toy oven more closely resemble an actual microwave oven. Also molded to the shell 3 are an input chute 23 and an output chute 25, upon which the pan 9 rests while being inserted into and removed from the baking chamber 7. The insertion and removal of the baking pan 9 is accomplished by use of a pusher 27 which is constructed with a stop 28. Electricity is provided to the heat source, a single light bulb 29, by an electrical cord and plug 31. The outer shell 3 includes a top surface 33, side surfaces 35 and 37 and a bottom 39. The side surfaces 35 and 37 are parallel to each other and approximately perpendicular to the top surface 33. The bottom surface 39 is approximately parallel to the top surface 33 and is indented from the side surfaces 35 and 37, so that it may fit in the lip in the base 5, as best seen in FIG. 3. The front portion 41 of the oven 1 which contains the door 16, push bottons 15 and heat control 17, is constructed to be rectangular in shape and to protrude outwardly from top surface 33, sides 35 and 37 and base 39. The underside of front surface 41 contains a plurality of holes 43 which extend in a longitudinal direction across the front face 41 of the oven and are constructed such that they are not blocked when the oven 1 sits on the base 5. These holes 43 function to provide additional ventilation for heating chamber 7.

Figure 2:
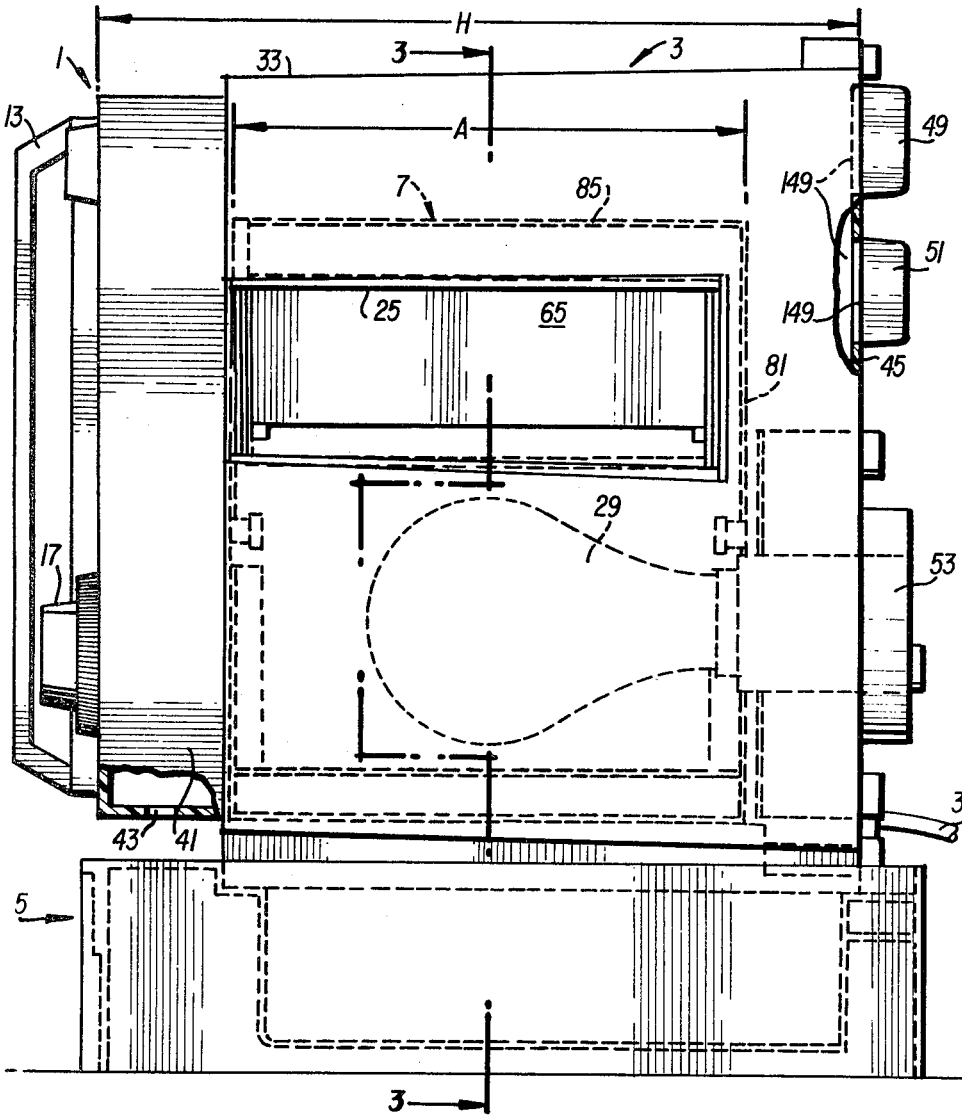
FIG. 2 is a side elevation, on a larger scale, of the discharge end of the oven of FIG. 1.

The placement of the baking chamber 7 within the oven 1 can be best seen with reference to FIG. 2. FIG. 2 also shows the back plate 45 of the oven 1 which is also constructed of molded plastic and is attached to the shell 3 by four screws, which are shown as elements 47 of FIG. 3. The back plate 45 of the oven also contains a plurality of fins 49 and 51 and cooling slots 149 which are utilized to aid in the cooling of the oven. These fins and cooling slots therebetween, extend longitudinally along the rear of the oven 1 in order to provide as much cooling and ventilation as possible. Each group of fins 49 and 51 and cooling slots 149 are parallel to each other and are generally perpendicular to the base 39 of the oven. The heating element, light bulb 29, is mounted in conventional light bulb socket 53 to which electrical cord and plug 31 is attached.

Figure 5:
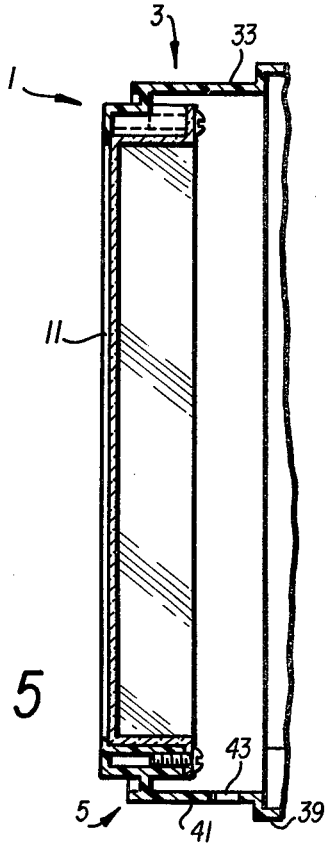
FIG. 5 is an enlarged fragmentary vertical sectional view, through the window of the oven, taken on line 5—5 of FIG. 1.

Referring now to FIG. 5, in order to bake food which has been prepared for the toy oven, the child places baking pan 9 into input chute 23 and pushes the pan with pusher 27. In order for the pan 9 to reach the baking chamber 7, it is pushed along the input chute 23, rests temporarily on input shelf 55, pushes open input door 57, which is mounted on shaft 61 for rotational movement. The door 57 is normally biased closed by a spring 59, which is also mounted to the shaft 61. The pan 9 comes to rest on baking surface 63, which will be described in more detail in connection with FIG. 4. After the proper time has elapsed, the pusher is again inserted into the oven until the stop 28 rests against the input chute 23. At this point, the baking pan 9 will be resting in output chute 25 so that it may cool sufficiently before it is removed from the oven. In order to move baking pan 9 into output chute 25, the following events occur. As the pan 9 leaves the baking chamber 7, it opens output door 65 which is mounted for rotation to a shaft 67 and biased in a normally closed position by spring 69. It should be also noted at this point that input door 57 is constructed such that it opens into the baking chamber 7 and output door 65 is constructed so that it opens out from the baking chamber 7. In their normally closed positions, both doors 57 and 65 close off the baking chamber 7 so as to retain the maximum amount of heat within the chamber 7. When the output door 65 is opened, it allows baking pan 9 to come to rest on output shelf 71 and ultimately in output chute 25.

Figure 6:
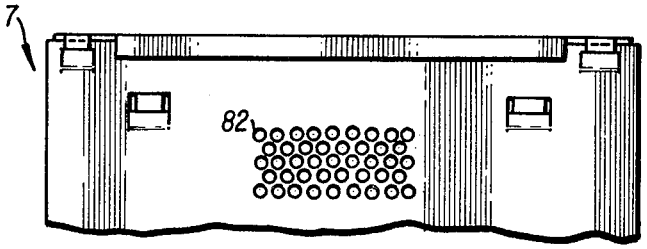
FIG. 6 is a fragmentary end elevational view of the baking chamber, taken on line 6—6 of FIG. 4.

The baking chamber 7 is constructed of an outer bottom 73, outer sides 75 and 77 and a front 79 and a back 81, all of which are constructed from one piece of light gauge metal such as tin plate, and formed into a desired shape, such as that illustrated in FIG. 3. The outer front 79 has a series of cooling holes 82 (see FIG. 6) which provide ventilation to the baking chamber 7. The back 81 of the baking chamber 7 is constructed with an opening 83 through which the light bulb 29 is inserted. The remainder of the outer portion of the baking chamber 7 is comprised of an outer top 85 which is attached to the remainder of the outer surfaces of the baking chamber 7. The baking chamber is also comprised of an inner bottom 87, inner sides 89 and 91 and a baking tray 63. The inner sides 89 and 91 are constructed to extend parallel to the outer sides 75 and 77 a short distance away therefrom, and up to the top surface of the baking tray 63. This allows for easy entry and exist of the baking pan 9 into and out of the chamber 7. An inner top surface 93 is mounted above and parallel to baking surface 63 by means of fasteners 95. The inner top surface 93 is constructed with a lip 97 which is perpendicular to the baking tray 63, in order to direct as much heat as possible towards the baking pan 9. The outer top 85 is attached to the outer sides 75 and 77 and the front 79 and back 81 of the baking chamber by metal fasteners 95.

Figure 4:
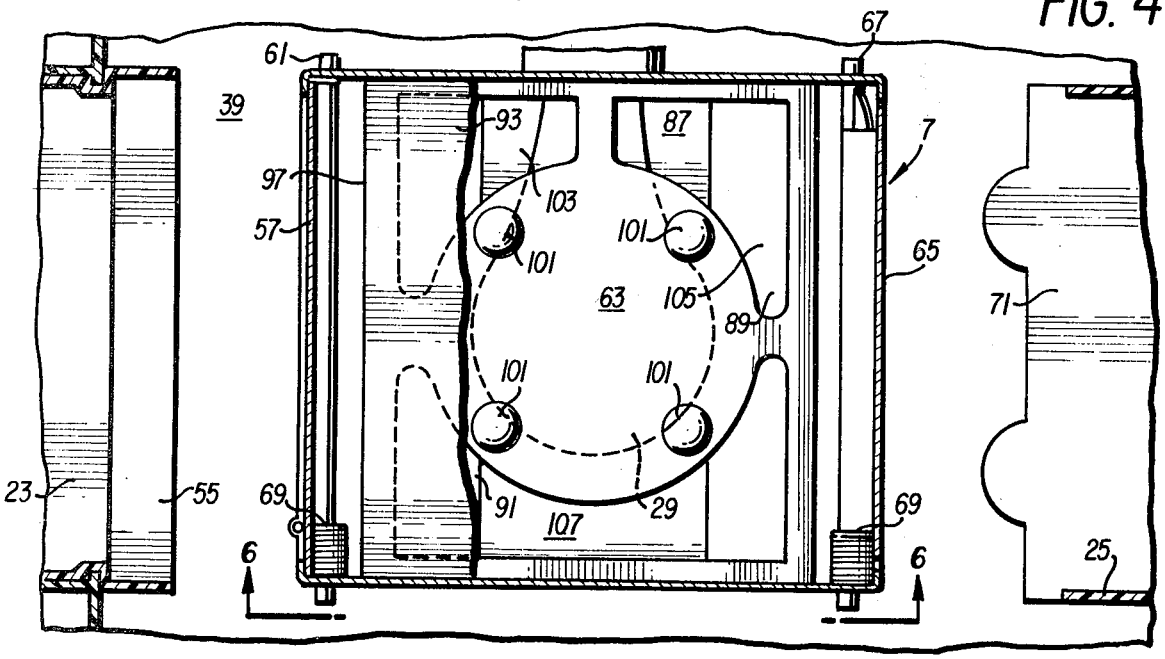
FIG. 4 is a fragmentary horizontal sectional view, taken on line 4—4 of FIG. 3.

Referring now to FIG. 4, baking surface 63 is of a generally circular shape and has raised portions 101 upon which the baking pan 9 sits and which allows heat to flow along the bottom surface of the baking pan. The baking surface 63 is part of a rectangular shaped piece of metal, with a circular shape centered in the rectangle and joined thereto at spaced points. The portion of the metal of the rectangular plate between surface 63 and the edge of the plate is removed, leaving cutouts 103, 105 and 107, through which heat rises to the top of the oven from the light bulb 29.

The instant invention is designed in such a way that only one light bulb, preferably, although not necessarily, a 100 watt light bulb, is required to obtain a uniform temperature within the baking chamber of approximately 325°. This result is accomplished by use of a small, approximately 70 cubic inch, oven chamber, which consists of inner and outer metal shells, as described hereinabove. The spacing between the two shells creates an effective dead air insulator which results in more of the generated energy from the light bulb staying in the baking chamber, thus maintaining a higher temperature uniformally distributed throughout the chamber. Although there is some motion of the "dead" air between the insulating wall, the motion is slow and generally parallel to the wall, therefore, it results in very little air movement perpendicular to the walls. This results in a minimal heat transfer from the inside wall containing the light bulb to the outside wall.

For optimum performance it has been found that the volume of the outer case should be such that the wattage of the light bulb used gives 0.4 watts per cubic inch of case volume. Optimum relative dimensions for the various parts are indicated herebelow with reference to basic dimension A (see FIG. 2) which is the front to back length of the outer shell of the baking chamber. With reference to that dimension, suitable relative values for the outer dimensions identified by capital letters in FIGS. 2 and 3, are: $B=1.11A$, $C=0.67A$, $D=1.11A$, $E=0.67A$, $J=0.1A$, $K=0.05A$, $F=1.33A$, $G=2.00A$, and $H=1.33A$. These particular dimensional relationships are for a 100 watt bulb, giving a wattage density of 1.2 watts per cubic inch within the baking chamber. This relationship has been found to be optimum and suitable for baking a cake in a reasonable time. If the device is constructed to accept a bulb of higher wattage, for example, 200 watts, the volumes described must be doubled to maintain the wattage density per cubic inch within the baking chamber.

Although the invention has been described in terms of selected preferred embodiments, the invention should not be deemed limited thereto, since other embodiments and modifications will readily occur to one skilled in the art. It is therefore to be understood that the appended claims are intended to cover all such modifications that fall within the true spirit and scope of the invention.

What is claimed is:

1. A toy oven for baking foods comprising:

(a) a baking pan for receiving foods to be baked;

(b) a double walled chamber defining an outer baking chamber between said walls with input and output doors disposed in opposite sides thereof a configuration sufficient to allow the entrance therethrough of said baking pan to the space between said double walls;

(c) the inner of said double walls defining a heating chamber and a horizontal baking shelf means for supporting said pan between said double walls and extending from said input door through said baking chamber to said output door;

(d) a single electric light bulb for said oven disposed within said heating chamber below said horizontal baking shelf for providing heat for baking said foods there being a convection current flow path from below said baking shelf through the space thereover;

(e) means venting to the atmosphere the areas of said baking chamber above said horizontal shelf means; and (f) shell means surrounding said baking chamber and including input and output shelf means.

2. The toy oven of claim 1, wherein said input and output doors are normally biased to a closed position.

3. The toy oven of claim 1, wherein said baking shelf means is comprised of pan support means including a plurality of raised portions for allowing heat to circulate beneath said baking pans and to allow heat from said light bulb to rise above said baking pan.

4. The toy oven of claim 1, wherein said shell means includes a plurality of cooling fins and slots for venting said baking chamber to said atmosphere.

5. The toy oven of claim 1, further including a separate pusher means for pushing a baking pan through said input door and into said baking chamber to rest on said horizontal baking shelf for baking.

6. The toy oven of claim 5, further including stop means on said pusher means so that said pusher means can push a baking pan only through said output door and onto an output shelf means for cooling.

7. The toy oven of claim 1 wherein the volume of said baking chamber is related to the wattage of said light bulb to provide approximately 1.2 watts per cubic inch of baking chamber volume.

* * * * *